US011280135B2

(12) United States Patent
Doud et al.

(10) Patent No.: US 11,280,135 B2
(45) Date of Patent: Mar. 22, 2022

(54) STEERING PAD OVEREXTENSION PREVENTION FOR ROTARY STEERABLE SYSTEM

(71) Applicant: Halliburton Energy Services, Inc., Houston, TX (US)

(72) Inventors: Brian Lee Doud, Spring, TX (US); Neelesh V. Deolalikar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/768,874

(22) PCT Filed: Mar. 2, 2018

(86) PCT No.: PCT/US2018/020783
§ 371 (c)(1),
(2) Date: Jun. 1, 2020

(87) PCT Pub. No.: WO2019/133034
PCT Pub. Date: Jul. 4, 2019

(65) Prior Publication Data

US 2020/0332599 A1 Oct. 22, 2020

Related U.S. Application Data

(60) Provisional application No. 62/612,173, filed on Dec. 29, 2017.

(51) Int. Cl.

| | |
|---|---|
| ***E21B 7/06*** | (2006.01) |
| ***E21B 4/02*** | (2006.01) |
| ***E21B 47/024*** | (2006.01) |

(52) U.S. Cl.
CPC ..... *E21B 7/068* (2013.01); *E21B 7/067* (2013.01); *E21B 4/02* (2013.01); *E21B 7/062* (2013.01); *E21B 7/064* (2013.01); *E21B 47/024* (2013.01)

(58) Field of Classification Search
CPC . E21B 7/068; E21B 7/067; E21B 4/02; E21B 7/062; E21B 7/064; E21B 47/024
See application file for complete search history.

(56) References Cited

U.S. PATENT DOCUMENTS

| | | | |
|---|---|---|---|
| 5,636,690 | A | 6/1997 | Garay |
| 2006/0157283 | A1 | 7/2006 | Hart |

(Continued)

FOREIGN PATENT DOCUMENTS

| | | |
|---|---|---|
| EP | 0841462 | 2/2003 |
| WO | 2001071149 | 9/2001 |

OTHER PUBLICATIONS

ISRWO International Search Report and Written Opinion for PCT/US2018/020783 dated Sep. 21, 2018.

*Primary Examiner* — Dany E Akakpo
(74) *Attorney, Agent, or Firm* — Benjamin Ford; C. Tumey Law Group PLLC

(57) ABSTRACT

A steering head for steering a drill string may include a pad pusher including a steering pad and a piston. The steering pad may have a pivot axis, and be rotatable about the pivot axis between retracted and extended positions. The pad pusher may further include a motion restrictor to restrict rotation about the pivot axis. The steering head may further include a housing having a motion restrictor disposed at a position corresponding to the pad pusher motion restrictor. The pad pusher motion restrictor may be engageable with the housing motion restrictor to restrict motion of the steering pad relative to the housing.

20 Claims, 6 Drawing Sheets

(56) References Cited

U.S. PATENT DOCUMENTS

| | | | | |
|---|---|---|---|---|
| 2006/0243487 | A1* | 11/2006 | Turner | E21B 7/062 175/26 |
| 2014/0262677 | A1* | 9/2014 | Beylotte | E21B 4/006 192/89.28 |
| 2015/0330149 | A1 | 11/2015 | Winslow et al. | |
| 2016/0356089 | A1 | 12/2016 | Nanayakkara et al. | |
| 2017/0159362 | A1 | 6/2017 | Janes et al. | |
| 2018/0094490 | A1* | 4/2018 | Lines | E21B 7/067 |
| 2018/0252088 | A1 | 9/2018 | Tilley et al. | |
| 2019/0249494 | A1 | 8/2019 | Winslow et al. | |
| 2019/0352558 | A1 | 11/2019 | Tilley et al. | |
| 2020/0011135 | A1 | 1/2020 | Deolalikar et al. | |
| 2020/0056451 | A1 | 2/2020 | Chambers et al. | |

* cited by examiner

STEERING PAD OVEREXTENSION PREVENTION FOR ROTARY STEERABLE SYSTEM

TECHNICAL FIELD

The present disclosure generally relates to oilfield equipment and, in particular, to downhole tools, drilling and related systems for steering a drill bit. More particularly still, the present disclosure relates to methods and systems for preventing overextension of the steering pads of a downhole tool.

BACKGROUND

Drilling wellbores in a subterranean formation usually requires controlling a trajectory of the drill bit as the wellbore is extended through the formation. The trajectory control can be used to steer the drill bit to drill vertical, inclined, horizontal, and lateral portions of a wellbore. In general the trajectory control can direct the drill bit into and/or through production zones to facilitate production of formation fluids, direct the drill bit to drill a portion of a wellbore that is parallel to another wellbore for treatment or production assist, direct the drill bit to intersect an existing wellbore, as well as many other wellbore configurations.

Therefore, it will be readily appreciated that improvements in the arts of preventing against overextension of the steering pads, so as to prevent the steering pads from becoming loose or completely coming apart during drilling operations, are continually needed.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
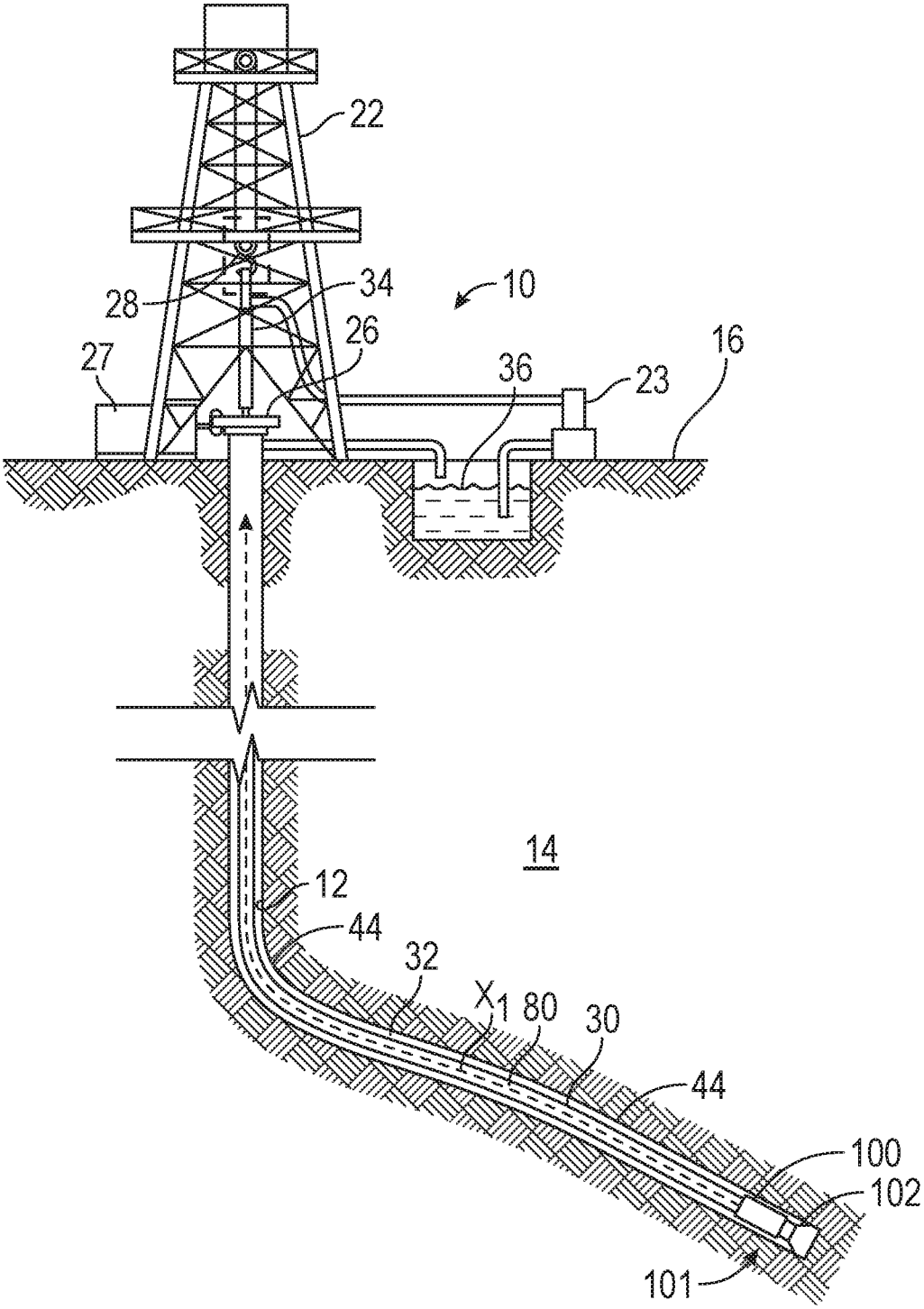
FIG. 1 illustrates a partial cross-sectional view of an onshore well system including a downhole tool illustrated as part of a tubing string, according to some embodiments of the present disclosure.

The disclosure may repeat reference numerals and/or letters in the various examples or Figures. This repetition is for the purpose of simplicity and clarity and does not in itself dictate a relationship between the some embodiments and/or configurations discussed.

The present disclosure further relates to methods and systems for preventing overextension of steering pads of a rotary steerable tool during drilling operations downhole. Generally, the present disclosure describes a rotary steerable tool for steering a drill string including a steering head that can include a stop mechanism for preventing overextension of the steering pads. This can be achieved by restricting a rotational motion of the steering about a pivot axis of the steering pad. It is advantageous to restrict rotation of the steering pads about the pivot axis to prevent the steering pads from pivoting too far past the fully extended position to a point where the piston is displaced out of the piston bore. The present disclosure provides systems and methods for restricting rotation of the steering pads, as discussed in further detail below.

In order to prevent the steering pads from extending to the point that the piston becomes displaced or separated from the piston liner, an extension-limiting mechanism can be provided which acts as a stop to restrict rotation of the steering pads past a desired point. The extension-limiting mechanism can prevent or minimize loss of various components of the steering head downhole, which may not otherwise be retrievable.

According to some embodiments of the disclosure, the pad pusher includes first and second motion-limiting protrusions extending laterally from side faces of the steering pad. The steering pad may be rotationally coupled to a housing about a pivot axis of the steering pad. The housing may have a retaining recess extending through each of an uphole and a downhole side thereof. In some embodiments, each retaining recess extends partially through a cross-section of the housing at the respective uphole and downhole sides. In other embodiments, each retaining recess extends all the way through a cross-section of the housing at the respective uphole and downhole sides. The retaining recesses may be disposed at a position aligned with the respective first and second motion-limiting protrusions to receive the respective first and second motion-limiting protrusions therein. When the piston is actuated, a corresponding force is transferred to the steering pad. In some embodiments the steering pad is integrally formed with the piston as a single, continuous body or material. In other embodiments, the piston is otherwise coupled to steering pad. Thus the steering pad and the piston can move together along the same curved path. Motion of the steering pad and the piston, i.e., the pad pusher, causes a corresponding motion of the first and second motion-limiting protrusions within the respective retaining recesses. Thus, rotation of the first and second motion-limiting protrusions is limited to a cross sectional area of the retaining recesses. Accordingly, rotation of the steering pads, which may be integrally formed with the first and second motion-limiting protrusions, is restricted to the extent the first and second motion-limiting protrusions rotate in the retaining recesses. As such, some embodiments of the present disclosure advantageously provide methods and apparatus for preventing overextension of the steering pads by limiting rotation of the pads about the pivot axis.

FIG. 1 shows a representative elevation view in partial cross-section of an onshore well system 10 which can include a drilling rig (or derrick) 22 at the surface 16 used to extend a tubing string 30 into and through portions of a subterranean earthen formation 14. The tubing string 30 can carry a drill bit 102 at its end which can be rotated to drill through the formation 14. A bottom hole assembly (BHA) 101 interconnected in the tubing string 30 proximate the drill bit 102 can include components and assemblies (not expressly illustrated in FIG. 1), such as, but not limited to, logging while drilling (LWD) equipment, measure while drilling (MWD) equipment, a bent sub or housing, a mud motor, a near bit reamer, stabilizers, steering assemblies such as a rotary steerable tool, a drill bit 102, and other downhole instruments. The BHA 101 can also include a downhole tool 100 that can provide steering to the drill bit 102, mud-pulse telemetry to support MWD/LWD activities, stabilizer actuation through fluid flow control, and near bit reamer control through fluid flow control. Steering of the drill bit 102 can be used to facilitate deviations 44 as shown in FIGS. 1 and 2, and/or steering can be used to maintain a section in a wellbore 12 without deviations, since steering control can also be needed to prevent deviations in the wellbore 12.

At the surface location 16, the drilling rig 22 can be provided to facilitate drilling the wellbore 12. The drilling rig 22 can include a turntable 26 that rotates the tubing string 30 and the drill bit 102 together about the longitudinal axis X1. The turntable 26 can be selectively driven by an engine 27, and selectively locked to prohibit rotation of the tubing string 30. A hoisting device 28 and swivel 34 can be used to manipulate the tubing string 30 into and out of the wellbore 12. To rotate the drill bit 102 with the tubing string 30, the turntable 26 can rotate the tubing string 30, and mud can be circulated downhole by mud pump 23. The mud may be a calcium chloride brine mud, for example, which can be pumped through the tubing string 30 and passed through the downhole tool 100. In some embodiments, the downhole tool 100 can include a steering head, and a rotary valve that selectively applies pressure to at least one output flow path to hydraulically actuate the steering head. Additionally, the mud, if used above the rotary steerable tool and drill bit, can be pumped through a mud motor (not expressly illustrated in FIG. 1) in the BHA 101 to turn the rotary steerable tool and the drill bit 102 without having to rotate the tubing string 30 via the turntable 26.

Figure 2:
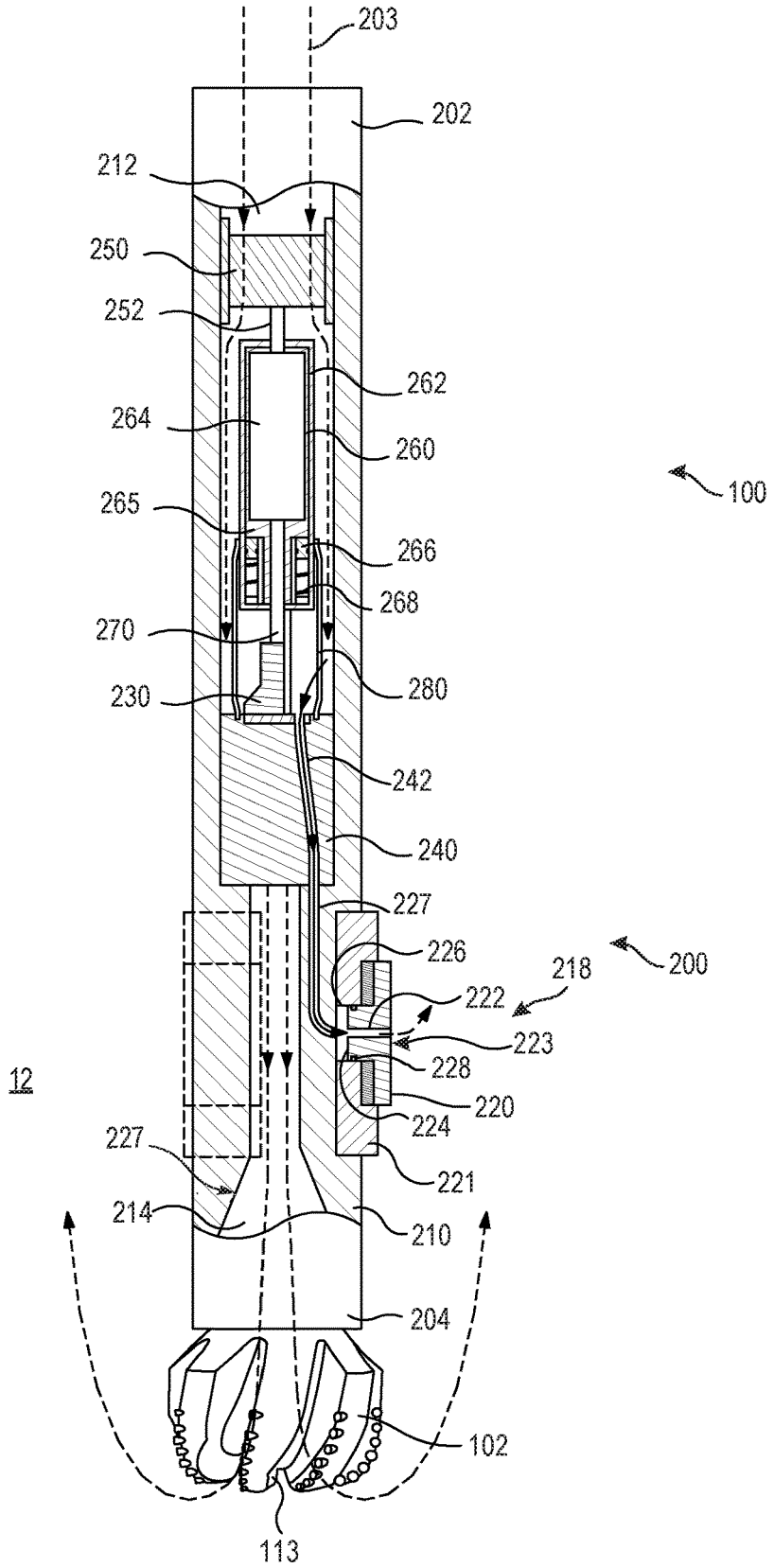
FIG. 2 illustrates a sectional view of the exemplary downhole tool of FIG. 1, including a steering head, according to some embodiments of the present disclosure.
Figure 3:
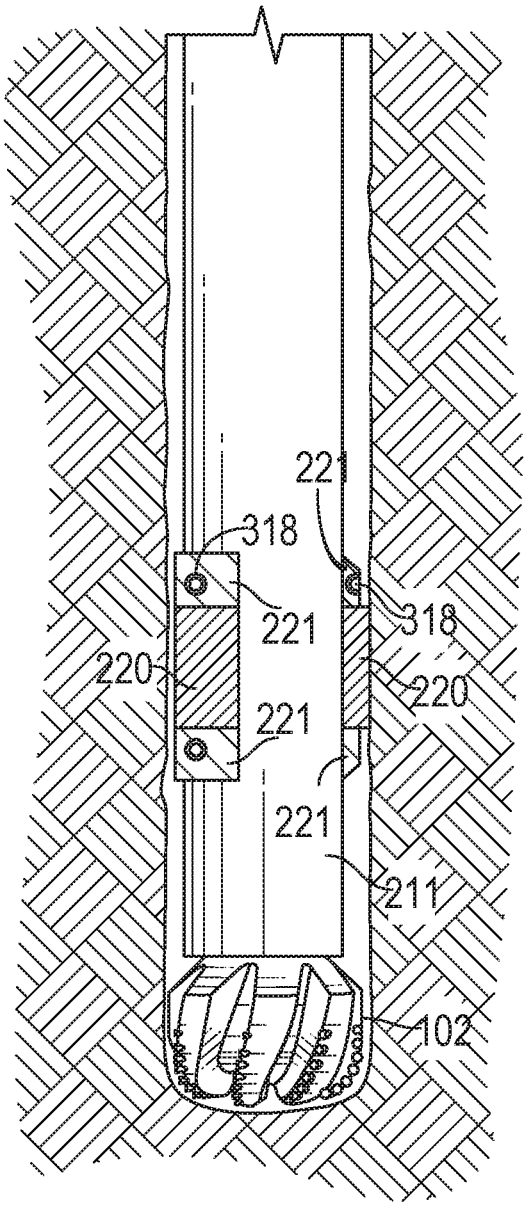
FIG. 3 illustrates a perspective side view of the exemplary downhole tool of FIG. 2.

FIG. 2 illustrates a sectional view of the exemplary downhole tool of FIG. 1, having a drill string steering system including a steering head, according to some embodiments of the present disclosure. FIG. 3 illustrates a perspective side view of the exemplary downhole tool of FIG. 2. According to various embodiments of the present inventions, the drill string system 200 includes a steering head 218 including one or more pad pushers 223. Although FIG. 2 depicts one pad pusher 223, the disclosed embodiments are not limited to this configuration. In some embodiments, as shall be later described, the steering head includes two pad pushers 223 (as illustrated in FIG. 3), and in other embodiments, three or more pad pushers 223. Each of the pad pushers 223 includes a steering pad 220 and a piston 224. As depicted, the steering pad 220 and the piston 224 may be coupled to each other using any suitable coupling mechanism. In some embodiments, the steering pad 220 and the piston 224 may be integrally formed as a single continuous body or material. In yet other embodiments, however, the piston 224 and the steering pad 220 may be separate components, with the piston 224 being actuatable to contact and move the steering pad 220 to push against the earth 102 to provide the desired drilling vector. As depicted in FIGS. 2 and 3, hydraulic fluid 203, e.g. mudflow flows into the drill string steering system 200 from the uphole end and passes through the central bore 212 to a rotary valve 230 and a flow manifold 240 to control mud flow to actuate the piston 224 which then operates to extend the steering pad 220.

As depicted, the steering head 218 is configured with a channel or bore 226 in which the piston 224 reciprocates upon being hydraulically or otherwise actuated. In some embodiments, the piston channel or bore 226 may be a linear channel or bore. In yet other embodiments, the piston channel or bore 226 in which the piston 224 reciprocates may be a curved channel or bore.

As the mud flows through the central bore 212, the mud can flow through a turbine 250 and past an electric generator, steering controller and motor assembly 260 used to control the angular position of the rotary valve 230. In the depicted example, mudflow 203 can pass through a filter screen 280 prior to passing through the rotary valve 230 and the flow manifold 240. The filter screen 280 can include apertures or openings sized to allow the flow of mud while preventing debris from passing through the flow manifold 240 and to components downstream of the flow manifold 240 to prevent obstruction and damage to the downstream components. The filter screen 280 can be formed from a metallic or ceramic perforated cylinder or mesh or any other suitable filter material.

In the depicted example, the rotary valve 230 and the flow manifold 240 regulate or control the flow of the mud there through to control the extension of the steering pads 220. In some embodiments, the rotation of the rotary valve 230 abutted against the flow manifold 240 controls the flow of mud through the flow manifold 240. The rotary valve 230 is rotated by a motor 264 within an electric generator, steering controller and electric motor assembly 260.

In the depicted example, as mud flow is permitted by the rotary valve 230, the mud flow can continue in a piston flow channel 242 of the flow manifold 240. In some embodiments, a piston flow channel 242 can pass through the flow manifold 240 and the tool body 210 to provide mud flow to the piston channel or bore 226. In the depicted example, the tool body includes one piston bore 226. However, as shall be illustrated and described in the various embodiments of the present disclosure, the tool body 210 can include one or more piston bores 226 formed in the tool body 210. In some embodiments, the piston bores 226 are disposed within a pad retention housing 221 formed within the tool body 210. In the depicted example, mud flow from the piston flow channel 242 is received by the piston bore 226 and the piston seals 228 to actuate and extend the piston 224. As illustrated, the steering pad 220 is integrally formed with the piston 224. However, as previously discussed, the steering pad 220 and the piston 224 may be separately formed and otherwise coupled. As described herein, the combination of the steering pad 220 and the piston 224, whether being formed as separate parts that are coupled together, or being formed as a part of a single, continuous body, shall be referred to as a pad pusher 223. The pad pusher 223 may be actuated by the mud flow provided through the piston flow channel 242, to extend the steering pad 220 radially outward against the wall of the wellbore 12.

Pressure against the piston 224 can be relieved by a relief flow channel 222 formed through the pad pusher 223. Mud flow can pass through the relief channel 222 to allow for maintaining or reducing pressure upon the piston 224 to facilitate the retraction of the piston 224 when the rotary valve 230 has closed mud flow to that piston.

In some embodiments, the mud flow can bypass the filter screen 280 and the flow manifold 240 to continue through the central bore 212 as a bypass flow 214. The bypass flow 214 can continue through the downhole end 204 of the drill string steering system 200 and can be directed to the bit nozzles 113 of the drill bit 102 to be circulated into an annulus of the wellbore 12.

In the depicted example, the motor 264 is an electrical motor that can be controlled to rotate the rotary valve 230 as desired to provide a desired drilling vector. In the depicted example, the motor 264 is contained within a motor housing 262 and rotates the rotary valve 230 via a motor shaft 270. In some embodiments, the motor 264 maintains the rotary valve 230 in a geostationary position as needed.

In the depicted example, components of the electric generator, steering controller and electric motor assembly 260 can be disposed, surrounded, bathed, lubricated, or otherwise exposed to a lubricant 265 within the motor housing 262 while many of the controller electronic components are protected in a pressure barrier cavity (not shown). In some embodiments the lubricant 265 is oil that is isolated from the mud within the wellbore. In the depicted example, the pressure of the lubricant 265 can be balanced with the downhole pressure of the mud. In some embodiments, a compensation piston 266 can pressurize the lubricant 265 to the same pressure as the surround mud without allowing fluid communication or mixing of the mud and the lubricant 265. In some embodiments, a biasing spring 268 can act upon the compensation piston 266 to further provide additional pressure to the lubricant 265 within the motor housing 262 relative to the pressure of the mud. The biasing spring 268 can impart around 25 psi of additional pressure, over the mud pressure, to the lubricant 265 within the motor housing 262. In some embodiments, electrical energy for the motor 264 is generated by mud flow passing through the turbine 250. In some embodiments, the turbine 250 can rotate about a turbine shaft 252 and power an electric generator.

In the depicted embodiments, the steering pad 220 and the piston 224 are integrally formed. However, as previously discussed, the steering pad 220 and the piston 224 may be separately formed and otherwise coupled. The term "integrally formed" can refer to a configuration in which the steering pad 220 and the piston 224 are formed as a single, continuous body or material. Thus, the steering pad 220 and the piston 224 move together along the same path. In some embodiments the path is a curved path which is defined by a curved piston liner defining the piston bore 226. In other embodiments, the piston channel or bore 226 may be a linear channel or bore. Thus, as depicted in FIG. 2, the piston 224 is actuated by the hydraulic fluid 203, e.g., pressurized mud flow, thereby causing the piston 224 and the steering pad 220 which move as an integral part, to move along the path defined by the piston liner. In some embodiments, the steering pad 220 can have a semi-circular cross-sectional profile.

In the example illustrated in FIG. 2, the pad pusher 223 is actuated by receiving mudflow 203 in the piston bore 226 from the piston flow channel 242. A piston seal 228 prevents the migration of fluid out of the piston bore 226. As the pad pusher 223 extends, the steering pad 220 can pivot about pivot coupling 227 relative to the tool collar 211.

Figure 4A:
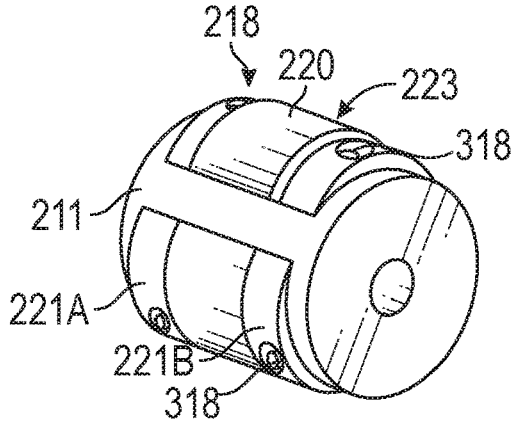
FIG. 4A illustrates a perspective sectional view of an exemplary embodiment of a steering head including a rotatable pad pusher, according to some embodiments.

FIG. 4A illustrates a perspective sectional view of an exemplary embodiment of a steering head 218 including a rotatable pad pusher 223, according to some embodiments. In the depicted embodiments, the steering head 218 includes a plurality of pad pushers 223 mounted onto or about the collar 211. Although two pad pushers are depicted in FIG. 4A, the steering head 218 is not limited to this configuration and may include only one pad pusher 223, or more than two pad pushers 223. In some embodiments, the steering head 218 includes one or more pad retention housings 221. Although two pad retention housings 221 are depicted in FIG. 4A, the steering head 218 is not limited to this configuration and may include only one pad retention housing 221 or more than two pad retention housings 221. As illustrated in FIG. 4A, each pad retention housing 221 may be mounted onto the collar 211 using fasteners 318. The fasteners 318 may be positioned through each of the pad retention housings 221 to couple the pad retention housings 221 to each other around and/or through the collar 211. As also illustrated in FIG. 4A, each of the pad pushers 223 can be mounted to the collar 211 via a respective pad retention housing 211. That is, since each of the pad pushers 223 are directly, pivotally coupled to a respective housing 221, each pad pusher 223 is thus indirectly coupled to the collar 211 through the pad retention housings 221.

Figure 4B:
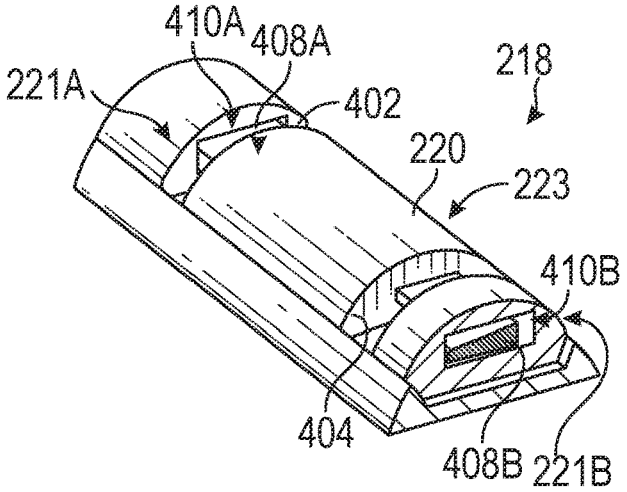
FIG. 4B illustrates a sectional view of the exemplary steering head of FIG. 4A, including a pad pusher disposed in a fully retracted position, according to some embodiments.

FIG. 4B illustrates a sectional view of the exemplary steering head 218 of FIG. 4A, including a pad pusher 223 disposed in a fully retracted position, according to some embodiments. As illustrated, the pad pusher 223 includes a steering pad 220 and a piston 224. The steering pad 220 has an uphole side 402, a downhole side 404, and a pivot axis. The pivot axis can extend through a rotational center of the pivot coupling 227. The pad pusher 223 may thus be rotatable about the pivot axis between retracted and extended positions, and includes a motion restrictor 408 to restrict rotation about the pivot axis. As depicted the steering head 218 further includes a housing 221 having a motion restrictor 410 disposed at a position corresponding to the pad pusher motion restrictor 408. Thus, the pad pusher motion restrictor 408 may be engageable with the housing motion restrictor 410 to restrict motion of the steering pad 220 relative to the housing 221.

In the depicted embodiments, the pad pusher motion restrictor 408 includes a first motion restrictor 408A at an uphole side, and a second motion restrictor 408B at a downhole side of the pad pusher 223. The housing motion restrictor 410 similarly includes a first motion restrictor 410A at an uphole side 210A, and a second motion restrictor 410B at a downhole side 210B of the housing 210. Thus, the first motion restrictor 408A of the pad pusher 223 may engage the first motion restrictor 410A of the housing 210, and the second motion restrictor 408B of the pad pusher may engage the second motion restrictor 410B of the second housing to restrict the motion of the steering pad 220 relative to the housing 221.

The first motion restrictor 408A of the pad pusher 223 may either be a first motion-limiting protrusion or a first retaining recess. Accordingly, the first motion restrictor 410A of the housing may either be a first retaining recess corresponding to the first motion-limiting protrusion of the pad pusher 223, or a first motion-limiting protrusion corresponding to the first retaining recess of the pad pusher 223. Similarly, the second motion restrictor 408B of the pad pusher 223 may either be a second motion-limiting protrusion or a second retaining recess. Accordingly, the second motion restrictor 410B of the housing 221 may either be a second retaining recess corresponding to the second motion-limiting protrusion of the pad pusher 223, or a second motion-limiting protrusion corresponding to the second retaining recess of the pad pusher 223. In some embodiments, the first and second motion restrictors of the housing may be first and second motion-limiting protrusions respectively, extending laterally from the respective uphole and downhole sides 221A and 221B of the housing 221. Accordingly, the first and second motion restrictors of the pad pusher 223 may be first and second retaining recesses extending laterally through the respective uphole and downhole sides 221A and 221B of the housing 221. Thus, the first and second retaining recesses are configured to receive the respective first and second motion-limiting protrusions therein.

Figure 4C:
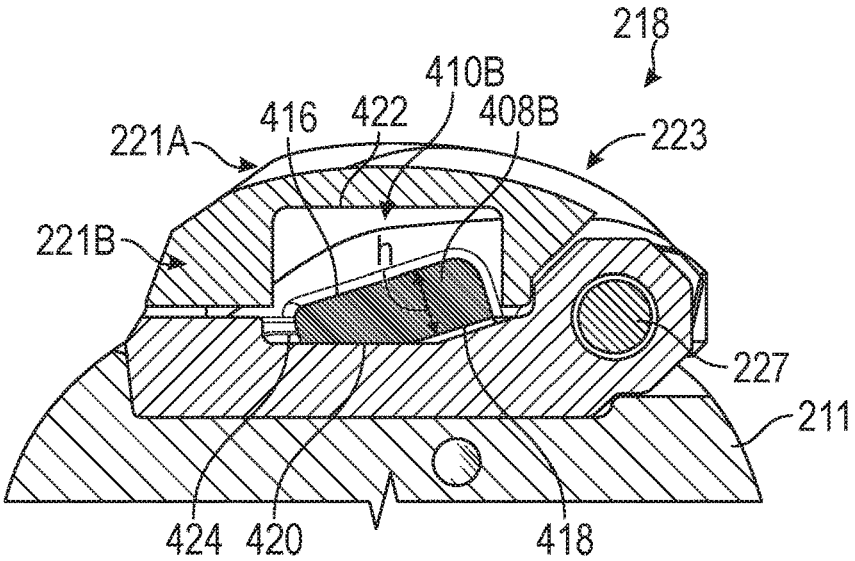
FIG. 4C is an exploded view of a steering pad of the exemplary steering head of FIG. 4B, including motion-limiting protrusions and retaining recesses, according to some embodiments.

In other embodiments, as depicted in FIGS. 4A-4C, the first and second motion restrictors of the pad pusher 223 are first and second motion-limiting protrusions 408A and 408B, extending laterally from the respective uphole and downhole sides of the pad pusher. Accordingly, the first and second motion restrictors of the housing are first and second retaining recesses 410A and 410B respectively, configured to receive the respective first and second motion-limiting protrusions 408A and 408B therein. As depicted, the first motion-limiting protrusion 408A extends laterally from the steering pad uphole side 402. Further, a second motion-limiting protrusion 408B extends laterally from the steering pad downhole side 404. The first and second motion-limiting protrusions 408A, and 408B may be formed at positions mirroring each other, on opposite faces or sides of the steering pad 220. That is, the first and second motion-limiting protrusions 408A, and 408B may be disposed on either side of a plane which extends through a center of the steering pad 220 in in a direction orthogonal to an uphole-downhole direction. In the depicted embodiments, each of the first and second motion-limiting protrusions 408A and 408B are integrally formed with the pad pusher 223. That is, the pad pusher 223 and the first and second motion-limiting protrusions 408A, and 408B are formed as a single, continuous body or material. However, the various embodiments described herein are not limited to the aforementioned configuration. In other embodiments, each of the first and second motion-limiting protrusions 408A and 408B may each be fixedly coupled or fastened to the pad pusher 223.

In the illustrated embodiments, cross-section of each of the first and second motion-limiting protrusions 408A, and 408B tapers in size along a plane orthogonal to an uphole-downhole direction of the steering pad 220. In particular, as illustrated for example, in FIG. 4C, a cross-sectional height h of each of the first and second motion-limiting protrusions 408A, and 408B diminishes in size along the plane orthogonal to an uphole-downhole direction of the steering pad 220. Referring to FIG. 4C, for example, each of the first and second motion-limiting protrusions 408A, and 408B have a first edge 416, and a second edge 418 positioned parallel to the first edge. In the depicted examples, the second edge is positioned below the first edge 416, however, the various embodiments described herein are not limited to the aforementioned configuration. Each of the first and second motion-limiting protrusions 408A, and 408B may further include and a third angularly oriented edge 420 coupled to at least one of the first and second edges. In the depicted examples, the third edge 420 is angularly oriented with respect to the first and second edges, however, the various embodiments described herein are not limited to the aforementioned configuration. The tapering shape of the first and second motion-limiting protrusions 408A, and 408B is defined by the angular orientation of the third edge 420 with respect to the first and second parallel edges 416, and 418.

As illustrated in FIG. 4B, the housing 221 couples the steering pad 220 of the pad pusher 223 to the tool collar 211. The housing 221 has a first retaining recess 410A extending through a cross-section of the uphole side 221A of the housing 221. The first retaining recess 410A is configured to receive the first motion-limiting protrusion 408A of the pad pusher 223 therein. Similarly, the housing 221 has a second retaining recess 410B extending through a cross-section of the downhole side 221B of the housing 221. In the same manner as the first retaining recess with respect to the uphole side 221A of the housing 221, the second retaining recess 410B is configured to receive the second motion-limiting protrusion 408B of the pad pusher 223 therein. To this effect, the shapes of each of the first and second retaining recesses 410A and 410B are designed so as to allow the first and second motion-limiting protrusions 408A, and 408B to rotate freely therein from a position of full retraction (illustrated in FIG. 4C), to a position of full acceptable extension (illustrated in FIG. 6C), as will be discussed in further detail below. The term "full acceptable extension" or as "full extension" can refer to a full extent to which the steering pad 220 can be pivoted outwards with respect to a central axis of the tool collar 211 without the piston 224 being displaced out of the piston bore 226.

As illustrated, for example in FIGS. 4B and 4C, each of the first and second retaining recesses 410A and 410B may have a trapezoidal shaped cross-section, with top edge 422 and the bottom edge 424 thereof being parallel to each other. In some embodiments, the trapezoidal shape may be a rectangular shape. In yet other embodiments, the trapezoidal shape may be a square shape. The aforementioned configuration, however, is not limited thereto. The first and second recesses retaining recesses 410A and 410B may have any shape capable of allowing the respective first and second motion-limiting protrusions 408A and 408B to rotate freely therein within the bounds of full retraction and full acceptable extension.

For example, in some embodiments, each of the first and second recesses retaining recesses 410A and 410B may have a shape corresponding to a profile, full or partial, such as a top or bottom, of the respective first and second motion-limiting protrusions 408A and 408B. In other embodiments, the first and second recesses retaining recesses 410A and 410B may have a shape larger in cross-sectional profile than that of the corresponding first and second motion-limiting protrusions 408A and 408B. This would allow the first and second motion-limiting protrusions 408A and 408B to rotate therein. As shall be described below in further detail, shapes or profiles of the first and second recesses retaining recesses 410A and 410B may be designed so as to restrict motion of the steering pad relative to the housing 221. Thus, motion of the steering pad relative to the housing 221 may be restricted by each of the first and second motion-limiting protrusions 408A and 408B contacting the housing 221.

Operation of the steering pad overextension prevention mechanism of some embodiments of the present disclosure will now be described below in further detail.

FIG. 4C is an exploded view of a steering pad 220 of the exemplary steering head 218 of FIG. 4B, including motion-limiting protrusions 408A and 408B, and retaining recesses 410A and 410B, according to some embodiments. As described above, the retaining recesses 410A and 410B are formed with a shape or profile configured to receive the respective first and second motion-limiting protrusions 408A and 408B therein. As illustrated in FIG. 4C, in the fully retracted position of the pad pusher 223, the third edge 420 of each of the first and second limiting protrusions 408A and 408B is positioned parallel to the bottom edge 424 of the respective first and second retaining recesses 410A and 410B. In the depicted example, the third edge 420 of each of the first and second limiting protrusions 408A and 408B is seated on the bottom edge 424 of the respective first and second retaining recesses 410A and 410B in the fully retracted position. However, the various embodiments described herein are not limited to the aforementioned configuration. In some embodiments, a gap may exist between the third edge 420 of each of the first and second limiting protrusions 408A and 408B and the bottom edge 424 of the respective first and second retaining recesses 410A and 410B in the fully retracted position. The pad pusher 223 may be in the fully retracted position, for example, before the piston 224 is actuated for steering the downhole tool. The pad pusher 223 may also be in the fully retracted position, for example, when the tool is moving downhole in a straight line where minimal to no steering is necessary.

Figure 5A:
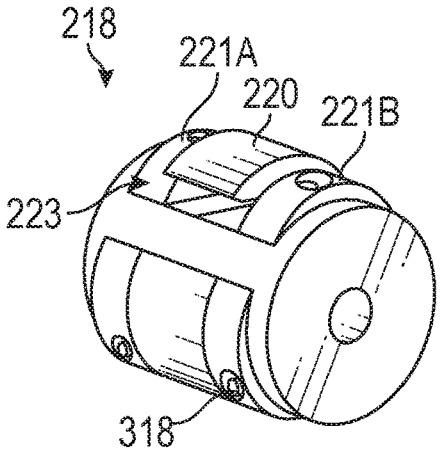
FIG. 5A illustrates a perspective sectional view of an exemplary embodiment of a steering head including a rotatable pad pusher, according to some embodiments.
Figure 5B:
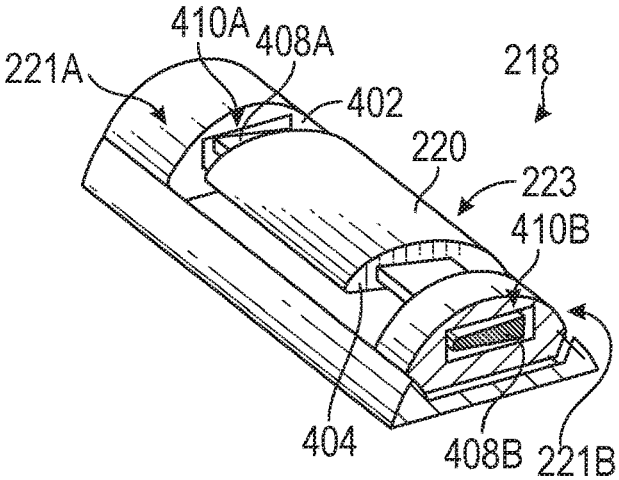
FIG. 5B illustrates a sectional view of the exemplary steering head of FIG. 5A, including a pad pusher disposed in a partially extended position, according to some embodiments.
Figure 5C:
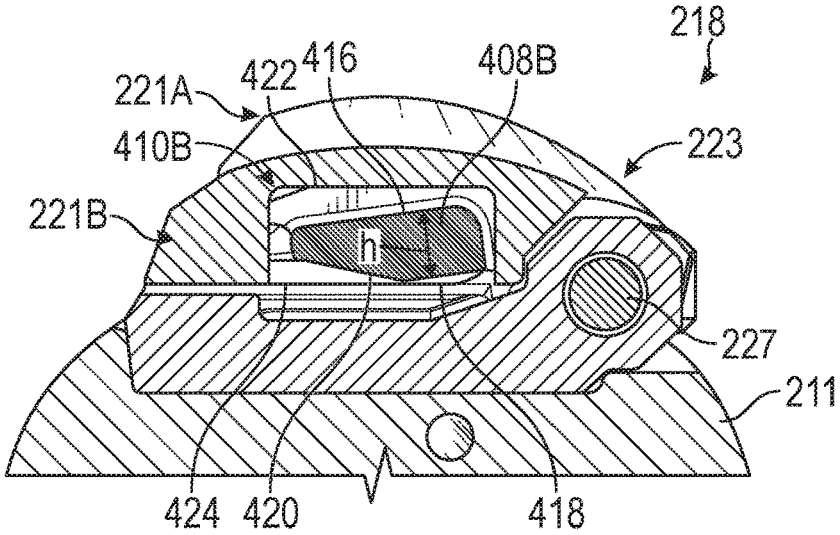
FIG. 5C is an exploded view of a steering pad of the exemplary steering head of FIG. 5B, including motion-limiting protrusions and retaining recesses, according to some embodiments.

FIG. 5A illustrates a perspective sectional view of an exemplary embodiment of a steering head 218 including a rotatable pad pusher 223, according to some embodiments. FIG. 5B illustrates a sectional view of the exemplary steering head 218 of FIG. 5A, including the pad pusher 223 disposed in a partially extended position, according to some embodiments. FIG. 5C is an exploded view of a steering pad of the exemplary steering head of FIG. 5B, including motion-limiting protrusions 408A and 408B and retaining recesses 410A and 410B, according to some embodiments.

In operation, the pad pusher 223 may be actuated by applying of hydraulic fluid (e.g., mud flow described above with respect to FIG. 2) to the piston 224. This causes the piston 224 to move up the piston bore 226 along the curved piston liner. Motion of the piston 224 along the piston liner causes a corresponding rotation of the integrally formed steering pad about the pivot axis. FIG. 5C illustrates a configuration in which the pad pusher 223 is in a partially extended position. The partially extended position is a position between the fully retracted and the fully extended positions. When the steering pad 220 rotates as a result of the piston force, which can be exerted on the piston by pressure of mud against the piston in a direction of extension, the first and second motion-limiting protrusions 408A and 408B rotate within the respective retaining recesses 410A and 410B, along a same path of curvature as the steering pad 220. Thus, the orientation of first and second motion-limiting protrusions 408A and 408B within the respective retaining recesses 410A and 410B changes from the illustration in FIG. 4C to that in FIG. 5C. Because the pad pusher 223 has not yet reached the limit of full acceptable extension, the first and second motion-limiting protrusions 408A and 408B may continue to rotate freely within the respective retaining recesses 410A and 410B.

Figure 6A:
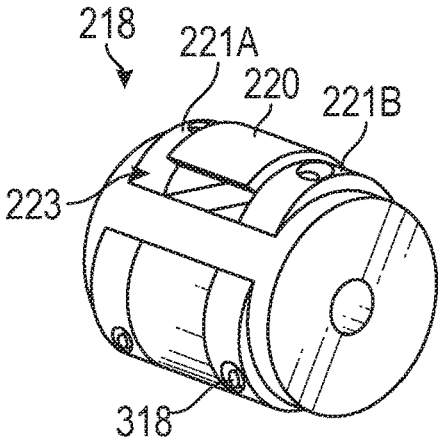
FIG. 6A illustrates a perspective sectional view of an exemplary embodiment of a steering head including a rotatable pad pusher, according to some embodiments.
Figure 6B:
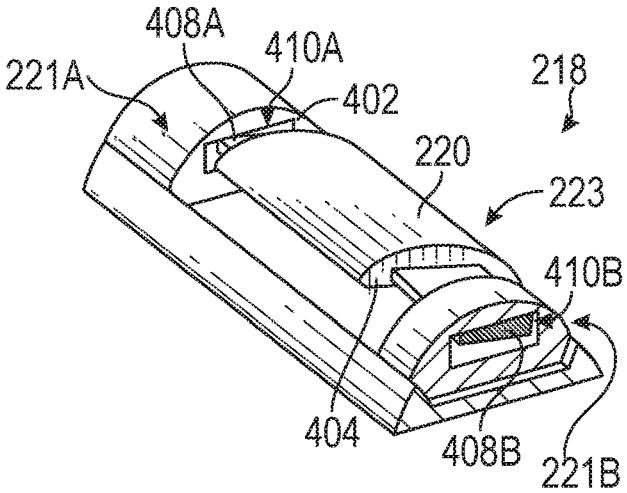
FIG. 6B illustrates a sectional view of the exemplary steering head of FIG. 6A, including a pad pusher disposed in a fully retracted position, according to some embodiments.
Figure 6C:
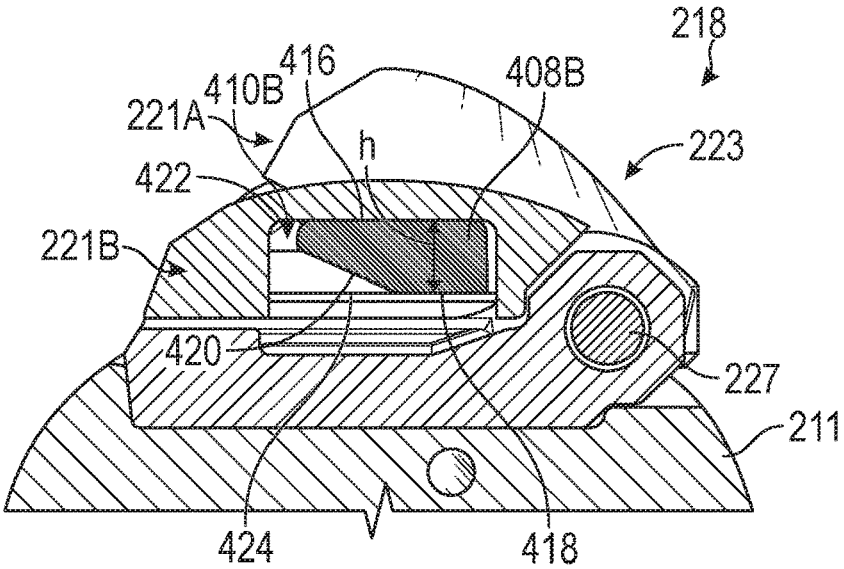
FIG. 6C is an exploded view of a steering pad of the exemplary steering head of FIG. 6B, including motion-limiting protrusions and retaining recesses, according to some embodiments.

FIG. 6A illustrates a perspective sectional view of an exemplary embodiment of a steering head 218 including a rotatable pad pusher 223, according to some embodiments. FIG. 6B illustrates a sectional view of the exemplary steering head of FIG. 6A, including a pad pusher 223 disposed in a fully retracted position, according to some embodiments. FIG. 6C is an exploded view of a steering pad of the exemplary steering head of FIG. 6B, including motion-limiting protrusions and retaining recesses, according to some embodiments. FIG. 6C illustrates a configuration in which the pad pusher 223 is in a fully extended position. The fully extended position is a position beyond which if the steering pad further extends, the piston is likely to become displaced from the piston liner and piston bore 226. As illustrated, in FIG. 6C, in the fully extended position, the first edge 416 abuts the top edge 422 of the respective uphole and downhole sides 221A and 221B of the housing 221. In this way, the top edges, e.g., edge 422 of each of the retaining recesses 410A and 410B act as a stop to restrict further rotation of the pad pusher 223 about the pivot axis. Additionally, in the fully extended position, the first edge 416 extends parallel to the top edge 422 of the respective first and second retaining recesses 410A and 410B.

Advantageously, various embodiments described herein can prevent the steering pad from rotating further than intended for the desired steering capability. Further, due to the capability of restricting rotation of the steering pad, the aforementioned configuration provides the advantage of preventing or minimizing the risk of the piston becoming displaced from the piston liner and piston bore. As a result, the piston may be prevented from becoming stuck after being displaced from the piston liner. Since the piston may be prevented from being removed from the liner, the chances of debris entering the liner and impeding steering control are minimized. The some embodiments described herein thus protect the steering head from additional damage.

Furthermore, by integrating the overextension prevention into the geometry of the steering pad and pad retention housings, it is possible to advantageously simplify the tool design by eliminating the need for additional stops in the steering head. This results in a more economical and more easily produced design. Additionally, the operating life of the tool is extended, for example, by virtue of not needing to provide additional stops which would potentially be subject to wear and breakage. Since the pad stops are provided in a same plane as the forces being applied to the pad pusher, the positioning of the pad stops (retaining recesses and limiting protrusions) provides better mechanical advantage over the forces the pad stops are counteracting. The stop distance can be changed prior to being run into the hole to select a desired minimum or maximum extension of the pad pusher using either different h sized limiting protrusions 408A and 408B or different positioned edges such as 422 or other ways to adjust the allowable pivot distance of the steering pad. In such instances it may be desirable to limit the allowable extension such that the pads do not extend beyond the diameter of the pervious casing or liner inner diameter for the interval being drilled so as to avoid the risk of the steering pad from getting caught on the bottom of the casing or liner when pulling the tool out of the hole or other potential obstructions. Hence the allowable swing or pivot range of steering pad may be selectable.

Various examples of aspects of the disclosure are described as numbered clauses (1, 2, 3, etc.) for convenience. These are provided as examples and do not limit the subject technology. Identification of the figures and reference numbers are provided below merely as examples for illustrative purposes, and the clauses are not limited by those identifications.

Clause 1: A steering head for steering a drill string, the steering head comprising: a pad pusher including a steering pad and a piston integrally formed, the steering pad having a pivot axis, and being rotatable about the pivot axis between retracted and extended positions, the pad pusher further including a motion restrictor to restrict rotation about the pivot axis; and a housing having a motion restrictor disposed at a position corresponding to the pad pusher motion restrictor, wherein the pad pusher motion restrictor is engageable with the housing motion restrictor to restrict motion of the steering pad relative to the housing.

Clause 2: The steering head of claim 1, wherein: the pad pusher motion restrictor comprises a first motion restrictor at an uphole side thereof, and a second motion restrictor at a downhole side thereof; the housing motion restrictor comprises a first motion restrictor at an uphole side thereof, and a second motion restrictor at a downhole side thereof; and the first motion restrictor of the pad pusher engages the first motion restrictor of the housing, and the second motion restrictor of the pad pusher engages the second motion restrictor of the second housing to restrict the motion of the steering pad relative to the housing.

Clause 3: The steering head of claim 2, wherein: the first motion restrictor of the pad pusher comprises one of a first motion-limiting protrusion or a first retaining recess, and the first motion restrictor of the housing comprises a remaining one of the first motion-limiting protrusion or the first retaining recess; and the second motion restrictor of the pad pusher comprises one of a second motion-limiting protrusion or a second retaining recess, and the second motion restrictor of the housing comprises a remaining one of the second motion-limiting protrusion or the second retaining recess;

Clause 4: The steering head of claim 1, wherein the first and second motion restrictors of the pad pusher comprise first and second motion-limiting protrusions extending laterally from the respective uphole and downhole sides; and the first and second motion restrictors of the housing comprise first and second retaining recesses respectively, configured to receive the respective first and second motion-limiting protrusions therein.

Clause 5: The steering head of Clause 4, wherein each of the first and second retaining recesses comprises a trapezoidal cross-section, with top and bottom edges thereof being parallel.

Clause 6: The steering head of Clause 5, wherein the trapezoidal shaped cross-section comprises a cross-section having a rectangular shape.

Clause 7: The steering head of Clause 5, wherein the trapezoidal cross-section comprises a cross-section having a square shape.

Clause 8: The steering head of Clause 4, wherein a cross-section of each of the first and second motion-limiting protrusions tapers in size along a plane orthogonal to an uphole-downhole direction of the steering pad.

Clause 9: The steering head of Clause 8, wherein the size comprises a height of the cross-section of each of the first and second motion-limiting protrusions.

Clause 10: The steering head of Clause 4, wherein each of the first and second motion-limiting protrusions comprise a first edge, a second edge parallel to the first edge, and a third angularly oriented edge coupled to at least one of the first and second edges.

Clause 11: The steering head of Clause 10, wherein in a fully retracted position of the pad pusher, the third edge is positioned parallel to a bottom edge of the respective first and second retaining recesses.

Clause 12: The steering head of Clause 10, wherein in a fully extended position of the pad pusher, the first edge abuts a top edge of the respective first and second retaining recesses to restrict further rotation of the pad pusher about the pivot axis in a first direction.

Clause 13: The steering head of Clause 12, wherein in the fully extended position of the pad pusher, the first edge extends parallel to the top edge of the respective first and second retaining recesses to restrict further rotation of the pad pusher about the pivot axis in a first direction.

Clause 14: The steering head of Clause 4, wherein the steering pad has a semi-circular cross-sectional profile and the pad pusher is attached to the tool via a pivot coupling.

Clause 15: A method of assembling a steering head of a rotary steerable tool for steering a drill string, wherein the steering head includes a steering pad and a piston formed as a pad pusher having first and second motion restrictors, and a housing having first and second motion restrictors, the method comprising: positioning the pad pusher with respect to the housing to align each of the first and second motion restrictors of the pad pusher with the respective first and second motion restrictors of the housing; engaging (1) the first motion restrictor of the pad pusher with the first motion restrictor of the housing, and (2) the second motion restrictor of the pad pusher with the second motion restrictor of the housing to restrict a rotational motion the steering pad relative to the housing; and pivotally coupling the pad pusher to the housing about a pivot axis of the steering pad, wherein the pad pusher is rotatable about the pivot axis between retracted and extended positions.

Clause 16: The method of Clause 15, further comprising coupling the pad pusher to a collar of the tool via the housing.

Clause 17: The method of Clause 16, wherein the pad pusher motion restrictor comprises a first motion restrictor at an uphole side thereof, and a second motion restrictor at a downhole side thereof, and the housing motion restrictor comprises a first motion restrictor at an uphole side thereof, and a second motion restrictor at a downhole side thereof, the method further comprising: restricting the motion of the steering pad relative to the housing by engaging (1) the first motion restrictor of the pad pusher with the first motion restrictor of the housing, and (2) the second motion restrictor of the pad pusher with the second motion restrictor of the housing.

Clause 18: The method of Clause 17, wherein: the first motion restrictor of the pad pusher comprises one of a first motion-limiting protrusion or a first retaining recess, and the first motion restrictor of the housing comprises a remaining one of the first motion-limiting protrusion or the first retaining recess; and the second motion restrictor of the pad pusher comprises one of a second motion-limiting protrusion or a second retaining recess, and the second motion restrictor of the housing comprises a remaining one of the second motion-limiting protrusion or the second retaining recess;

The steering head of Clause 18, wherein: the first and second motion restrictors of the pad pusher comprise first and second motion-limiting protrusions extending laterally from the respective uphole and downhole sides; and the first and second motion restrictors of the housing comprise first and second retaining recesses respectively, configured to receive the respective first and second motion-limiting protrusions therein.

Clause 19: The method of Clause 18, wherein a cross-section of each of the first and second motion-limiting protrusions tapers in size in a direction from the downhole side to the uphole side of the steering pad.

Clause 20: The method of Clause 19, wherein the size comprises a height of the cross-section of each of the first and second motion-limiting protrusions.

Clause 21: The method of Clause 18, wherein each of the first and second motion-limiting protrusions each comprise a first edge, a second edge parallel to and disposed below the first edge, and a third edge angularly positioned with respect to the first and second edges.

Clause 22: The method of Clause 21, wherein in a fully retracted position of the pad pusher, the third edge is positioned parallel to a bottom edge of the respective first and second retaining recesses.

Clause 23: The method of Clause 21, wherein in a fully extended position of the pad pusher, the first edge abuts a top edge of the respective first and second retaining recesses to restrict further rotation of the pad pusher about the pivot axis in a first direction.

Clause 24: The method of Clause 23, wherein in the fully extended position of the pad pusher, the first edge extends parallel to the top edge of the respective first and second retaining recesses to restrict further rotation of the pad pusher about the pivot axis in a first direction.

What is claimed is:

1. A steering head for steering a drill string, the steering head comprising:

a pad pusher including a steering pad and a piston, the steering pad having a pivot axis and being rotatable about the pivot axis between retracted and extended positions, the pad pusher further including a motion restrictor to restrict rotation about the pivot axis, wherein the pad pusher motion restrictor comprises a first motion restrictor at an uphole side thereof, and a second motion restrictor at a downhole side thereof;

a housing having a motion restrictor disposed at a position corresponding to the pad pusher motion restrictor, wherein the pad pusher motion restrictor is engageable with the housing motion restrictor to restrict motion of the steering pad relative to the housing, wherein the housing motion restrictor comprises a first motion restrictor at an uphole side thereof, and a second motion restrictor at a downhole side thereof; and wherein the first motion restrictor of the pad pusher engages the first motion restrictor of the housing, and the second motion restrictor of the pad pusher engages the second motion restrictor of the housing to restrict the motion of the steering pad relative to the housing.

2. The steering head of claim 1, wherein:

the first motion restrictor of the pad pusher comprises one of a first motion-limiting protrusion or a first retaining recess, and the first motion restrictor of the housing comprises a remaining one of the first motion-limiting protrusion or the first retaining recess; and the second motion restrictor of the pad pusher comprises one of a second motion-limiting protrusion or a second retaining recess, and the second motion restrictor of the housing comprises a remaining one of the second motion-limiting protrusion or the second retaining recess.

3. The steering head of claim 1, wherein:

the first and second motion restrictors of the pad pusher comprise first and second motion-limiting protrusions extending laterally from the respective uphole and downhole sides; and the first and second motion restrictors of the housing comprise first and second retaining recesses respectively, configured to receive the respective first and second motion-limiting protrusions therein.

4. The steering head of claim 3, wherein each of the first and second retaining recesses comprises a trapezoidal cross-section, with top and bottom edges thereof being parallel.

5. The steering head of claim 3, wherein a cross-section of each of the first and second motion-limiting protrusions tapers in size along a plane orthogonal to an uphole-downhole direction of the steering pad.

6. The steering head of claim 5, wherein the size comprises a height of the cross-section of each of the first and second motion-limiting protrusions.

7. The steering head of claim 3, wherein each of the first and second motion-limiting protrusions comprise a first edge, a second edge parallel to the first edge, and a third angularly oriented edge coupled to at least one of the first and second edges.

8. The steering head of claim 7, wherein in a fully retracted position of the pad pusher, the third edge is positioned parallel to a bottom edge of the respective first and second retaining recesses.

9. The steering head of claim 7, wherein in a fully extended position of the pad pusher, the first edge abuts a top edge of the respective first and second retaining recesses to restrict further rotation of the pad pusher about the pivot axis in a first direction.

10. The steering head of claim 7, wherein in a fully extended position of the pad pusher, the first edge extends parallel to a top edge of the respective first and second retaining recesses to restrict further rotation of the pad pusher about the pivot axis in a first direction.

11. A method of assembling a steering head of a rotary steerable tool for steering a drill string, wherein the steering head includes a steering pad and a piston formed as a pad pusher having first and second motion restrictors, and a housing having first and second motion restrictors, the method comprising:

positioning the pad pusher with respect to the housing to align each of the first and second motion restrictors of the pad pusher with the respective first and second motion restrictors of the housing;

engaging (1) the first motion restrictor of the pad pusher with the first motion restrictor of the housing, and (2) the second motion restrictor of the pad pusher with the second motion restrictor of the housing to restrict a rotational motion the steering pad relative to the housing; and pivotally coupling the pad pusher to the housing about a pivot axis of the steering pad, wherein the pad pusher is rotatable about the pivot axis between retracted and extended positions.

12. The method of claim 11, further comprising coupling the pad pusher to a collar of the tool via the housing.

13. The method of claim 11, wherein the pad pusher motion restrictor comprises the first motion restrictor at an uphole side thereof, and the second motion restrictor at a downhole side thereof, and the housing motion restrictor comprises the first motion restrictor at an uphole side thereof, and the second motion restrictor at a downhole side thereof, the method further comprising:

restricting the motion of the steering pad relative to the housing by engaging (1) the first motion restrictor of the pad pusher with the first motion restrictor of the housing, and (2) the second motion restrictor of the pad pusher with the second motion restrictor of the housing.

14. The method of claim 13, wherein:

the first motion restrictor of the pad pusher comprises one of a first motion-limiting protrusion or a first retaining recess, and the first motion restrictor of the housing comprises a remaining one of the first motion-limiting protrusion or the first retaining recess; and the second motion restrictor of the pad pusher comprises one of a second motion-limiting protrusion or a second retaining recess, and the second motion restrictor of the housing comprises a remaining one of the second motion-limiting protrusion or the second retaining recess.

15. The steering head of claim 14, wherein:

the first and second motion restrictors of the pad pusher comprise the first and second motion-limiting protrusions extending laterally from the respective uphole and downhole sides; and the first and second motion restrictors of the housing comprise the first and second retaining recesses respectively, configured to receive the respective first and second motion-limiting protrusions therein.

16. The method of claim 15, wherein a cross-section of each of the first and second motion-limiting protrusions tapers in size in a direction from the downhole side to the uphole side of the steering pad.

17. The method of claim 15, wherein each of the first and second motion-limiting protrusions each comprise a first edge, a second edge parallel to the first edge, and a third angularly oriented edge coupled to at least one of the first and second edges.

18. The method of claim 17, wherein in a fully retracted position of the pad pusher, the third edge is positioned parallel to a bottom edge of the respective first and second retaining recesses.

19. The method of claim 17, wherein in a fully extended position of the pad pusher, the first edge abuts a top edge of the respective first and second retaining recesses to restrict further rotation of the pad pusher about the pivot axis in a first direction.

20. A steering head for steering a drill string, the steering head comprising:

a collar;

a pad retention housing, wherein the pad retention housing includes a first retention restrictor at an uphole side thereof and a second retention restrictor at a downhole side thereof, wherein the pad retention housing is mounted on the collar with fasteners positioned through the pad retention housing to couple the pad retention housing to the collar; and a pad pusher, where the pad pusher includes a steering pad and a piston, the steering pad having a pivot axis and being rotatable about the pivot axis between retracted and extended positions, the pad pusher further including a first pad pusher motion restrictor at an uphole side thereof and a second pad pusher motion restrictor at a downhole side thereof;

wherein the first pad pusher motion restrictor is engageable with the first retention restrictor to restrict rotation of the pad pusher about the pivot axis and also restrict motion of the steering pad relative to the pad retention housing;

wherein the second pad pusher motion restriction is engageable with the second retention restrictor to restrict rotation of the pad pusher about the pivot axis and also restrict motion of the steering pad relative to the pad retention housing;

wherein either (1) the first and second retention restrictors are retaining recesses and the first and second pad pusher motion restrictors are protrusions or (2) the first and second retention restrictors are protrusions and the first and second pad pusher motion restrictors are retaining recesses; and wherein the protrusions taper in size along a plane orthogonal to an uphole direction of the steering pad.

* * * * *